US008491158B1

(12) United States Patent
Scolum

(10) Patent No.: US 8,491,158 B1
(45) Date of Patent: Jul. 23, 2013

(54) SHIELDED DROPLIGHT AND ASSOCIATED METHOD

(76) Inventor: George Scolum, Alsip, IL (US)

( * ) Notice: Subject to any disclaimer, the term of this patent is extended or adjusted under 35 U.S.C. 154(b) by 212 days.

(21) Appl. No.: 12/978,297

(22) Filed: Dec. 23, 2010

Related U.S. Application Data

(60) Provisional application No. 61/289,513, filed on Dec. 23, 2009.

(51) Int. Cl.
*F21V 21/26* (2006.01)

(52) U.S. Cl.
USPC ..... 362/269; 362/277

(58) Field of Classification Search
USPC ..... 362/296.014, 307, 370, 396, 269, 362/277, 291, 300
See application file for complete search history.

(56) References Cited

U.S. PATENT DOCUMENTS

| | | | | | |
|---|---|---|---|---|---|
| 1,692,892 | A * | 11/1928 | Floyd | ..... | 362/378 |
| 2,143,148 | A | 1/1939 | Guth | | |
| 2,861,175 | A * | 11/1958 | Schweikle | ..... | 362/296.05 |
| 3,755,668 | A * | 8/1973 | Moreschini | ..... | 362/282 |
| 3,828,181 | A * | 8/1974 | Goodwin | ..... | 362/269 |
| 5,313,379 | A | 5/1994 | Lemons et al. | | |
| 5,961,207 | A * | 10/1999 | Petkovic | ..... | 362/376 |
| 6,170,966 | B1 * | 1/2001 | Schwarzmann | ..... | 362/376 |
| 6,652,127 | B2 | 11/2003 | Tarabula | | |
| 7,234,833 | B2 * | 6/2007 | Hatherill et al. | ..... | 362/198 |
| 7,452,111 | B2 | 11/2008 | Mazzei | | |
| 7,473,010 | B2 | 1/2009 | O'Brien et al. | | |
| 2006/0013005 | A1 | 1/2006 | Jiao | | |

* cited by examiner

*Primary Examiner* — Julie Shallenberger

(57) ABSTRACT

A shielded droplight may include a rotatable external shield having a cylindrical shape with an open top end. A semi-circular shaped directional reflector may be statically mated to the external shield and spaced inwardly from a circumference of the external shield. A stationary internal shield having a cylindrical shape may be dynamically mated to the external shield and spaced inwardly from a circumference of the directional reflector. A light emitting source may be housed within the internal shield. A light emitting source holder may be coupled to the external shield and extending downwardly therefrom. The external shield and directional reflector may contemporaneously rotate along a curvilinear path spaced about the circumference of the internal shield. The external shield may include a tab protruding outwardly from its circumference and a base. The apparatus may further include a hanging arm statically mated directly to the light emitting source holder.

12 Claims, 4 Drawing Sheets

SHIELDED DROPLIGHT AND ASSOCIATED METHOD

CROSS REFERENCE TO RELATED APPLICATIONS

This application claims the benefit of U.S. Provisional Application No. 61/289,513, filed Dec. 23, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to drop lights and, more particularly, to a shielded droplight for providing users with an easy and convenient means of adjustably reflecting its light on a focused area in use.

2. Prior Art

Lighting includes use of both artificial light sources such as lamps and natural illumination of interiors from daylight. Daylighting (through windows, skylights, etc.) is often used as the main source of light during daytime in buildings given its low cost. Artificial lighting represents a major component of energy consumption, accounting for a significant part of all energy consumed worldwide. Artificial lighting is most commonly provided today by electric lights, but gas lighting, candles, or oil lamps are still used in certain situations. Proper lighting can enhance task performance or aesthetics, while there can be energy wastage and adverse health effects of poorly designed lighting. Lighting fixtures come in a wide variety of styles for various functions. The most important functions are as a holder for the light source, to provide directed light and to avoid visual glare. Some are very plain and functional, while some are pieces of art in themselves. Nearly any material can be used, so long as it can tolerate the excess heat and is in keeping with safety codes.

Artificial lighting consumes a significant part of all electrical energy consumed worldwide. In homes and offices from 20 to 50 percent of total energy consumed is due to lighting. Most importantly, for some buildings over 90 percent of lighting energy consumed can be an unnecessary expense through over-illumination. For example, a single 100 W light bulb used just 6 hours a day can cost over $25 per year to use. Thus lighting represents a critical component of energy use today, especially in large office buildings where there are many alternatives for energy utilization in lighting. A droplight may reduce unnecessary light pollution and save energy by "dropping" the light source to the object so the distance between them is nearer. Unfortunately, most droplights are designed to direct light downwards or over 360° in the case of droplights using bulbs. Most of these lights are wasted in the sense that only a certain location need to be lighted for focused use and much electrical energy may go to waste apart from the irritation of someone close by who may not need the light.

Accordingly, a need remains for an apparatus in order to overcome the above-noted shortcomings. The present invention satisfies such a need by providing a shielded droplight with a directional deflector that is convenient and easy to use, is durable yet lightweight in design, is versatile in its applications, and provides users with an easy and convenient means of adjustably reflecting its light on a focused area in use.

BRIEF SUMMARY OF THE INVENTION

In view of the foregoing background, it is therefore an object of the present invention to provide an apparatus for aiming light towards a work area. These and other objects, features, and advantages of the invention are provided by a shielded droplight.

The shielded droplight may include a rotatable external shield preferably having a cylindrical shape with an open top end. A semi-circular shaped directional reflector may be statically mated to the external shield and spaced inwardly from a circumference of the external shield. A stationary internal shield preferably having a cylindrical shape may be dynamically mated to the external shield and spaced inwardly from a circumference of the directional reflector. A light emitting source may be housed within the internal shield. A light emitting source holder may further be coupled to the external shield and extending downwardly therefrom. In this way, the external shield and directional reflector may contemporaneously rotate along a curvilinear path spaced about the circumference of the internal shield. Such an arrangement provides the unexpected and unpredictable advantage of rotatably adjusting the external shield of the apparatus so that light may be efficiently reflected from the directional reflector on a work area and at the same time allowing the directional reflector to block the light from falling on and thus disturbing another person in close proximity to the user.

The external shield may include a tab affixed protruding outwardly from the circumference of the external shield. The tab may remain spaced from the internal shield and the directional reflector. Such a tab may advantageously be used to rotate the external shield and further preventing the user's finger from touching and possibly be burned by the hot apparatus when in use.

The external shield may include a base. Such a base may include a lower hemisphere rotatably and directly coupled to a top end of the light emitting source holder and preferably having a circular track formed along a top surface thereof. The base may further include an upper hemisphere dynamically and directly coupled to the top end of the light emitting source holder. The upper hemisphere may further remain juxtaposed to the lower hemisphere. In this way, a bottom end of the internal shield may be rotatably interfitted within the circular track in such a manner that the internal shield and the upper hemisphere remain stationary as the lower hemisphere rotates about the top end of the light emitting source holder. The external shield and the directional reflector may concentrically rotate about the internal shield in such a manner that light is reflected away from the directional reflector and outwardly through a portion of the internal and external shields respectively. Such an arrangement provides the unexpected and unpredictable advantage of rotating the external shield and directional reflector about the base without affecting the internal shield which remains affixed to the light emitting source holder.

The apparatus may further include a hanging arm statically mated directly to the light emitting source holder and extending upwardly therefrom. The hanging arm may be abutted directly against an outer surface of the external shield and traveling along an entire longitudinal length thereof such that the hanging arm terminates above the external shield. The hanging arm may include a first hook formed at a top end of the hanging arm and a second hook formed substantially medially between the top end of the hanging arm and a bottom end of the hanging arm. In this way, the first hook may be oriented perpendicular to the second hook such that the directional reflector is oriented along one corresponding x and y axes respectively. Such an arrangement provides the unexpected and unpredictable advantage of allowing the apparatus to be hung adjacent to or above a user thus providing a versatile light focusing source that is useful in a number of leisure or work activities for example, reading, cooking or doing maintenance work in a garage.

The light emitting source holder may include a power cord capable of being electrically coupled to an external power source and a switch located subjacent to the external shield. The switch may be capable of toggling the light emitting source between on and off modes while the internal shield remains stationary.

The disclosure may include a method of utilizing a shielded droplight for aiming light towards a work area. Such a method may include the chronological steps of: providing a rotatable external shield preferably having a cylindrical shape with an open top end; providing and statically mating a semicircular shaped directional reflector to the external shield; spacing the directional reflector inwardly from a circumference of the external shield; providing a stationary internal shield preferably having a cylindrical shape; dynamically mating the internal shield to the external shield by spacing the internal shield inwardly from a circumference of the directional reflector; providing and housing a light emitting source within the internal shield; providing and coupling a light emitting source holder to the external shield such that the light emitting source holder extends downwardly therefrom; and contemporaneously rotating the external shield and directional reflector along a curvilinear path spaced about the circumference of the internal shield.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
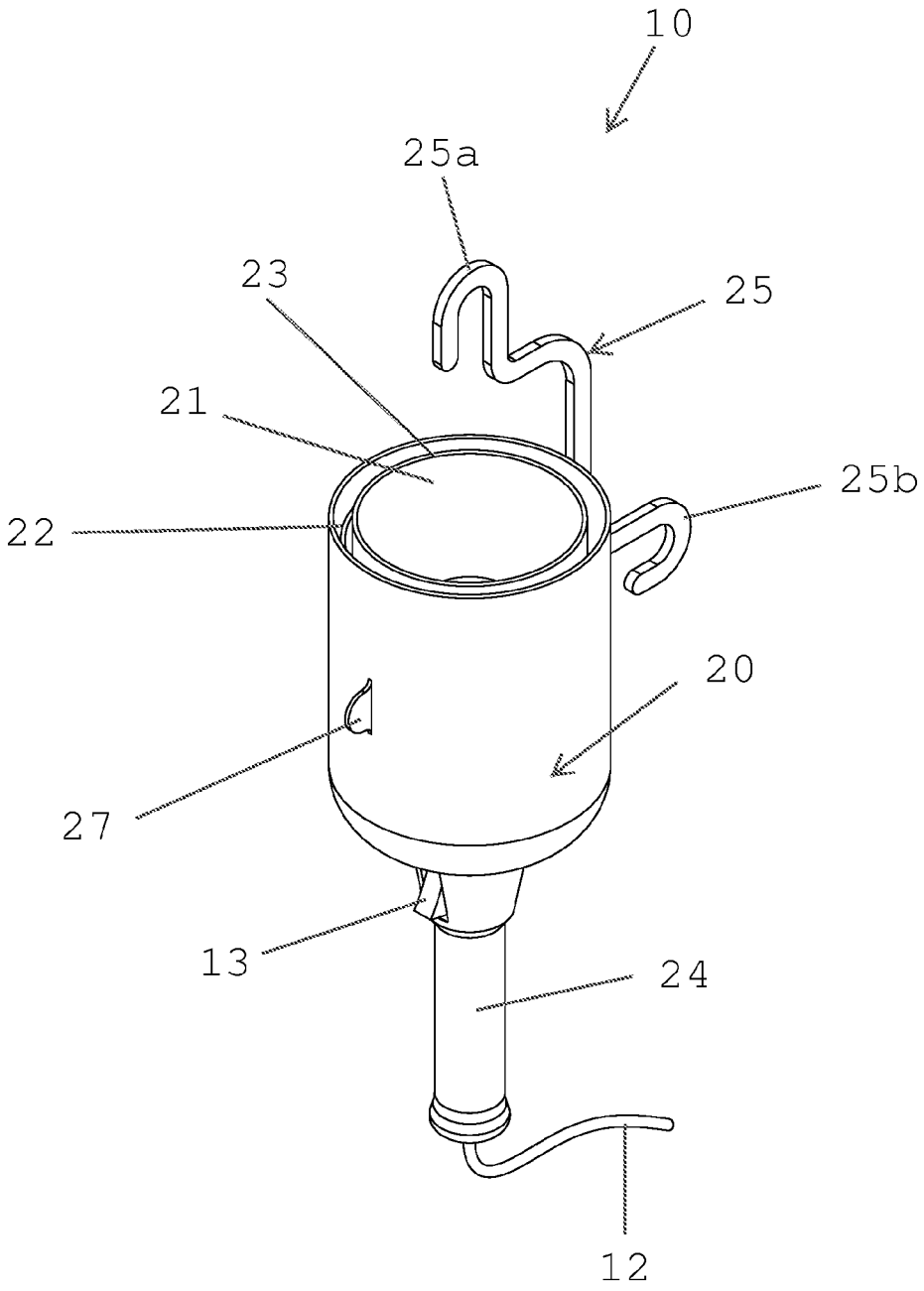
FIG. 1 is a perspective view showing a shielded droplight, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The apparatus of this invention is referred to generally in FIGS. 1-4 and is intended to provide a shielded droplight. It should be understood that the present invention may be used to adjustably reflect its light on a desired area in many different types of locations, and should not be limited to the uses described herein.

Referring to FIGS. 1-4, the shielded droplight 10 may include a rotatable external shield 20 preferably having a cylindrical shape with an open top end 21. A semi-circular shaped directional reflector 22 may be statically mated to the external shield 20 and spaced inwardly from a circumference of the external shield 20. A stationary internal shield 23 preferably has a cylindrical shape and may be dynamically mated to the external shield 20 such that internal shield 23 remains spaced inwardly from a circumference of the directional reflector 22. Of course, one skilled in the art understands various shapes and sized may be employed without departing from the true scope of the present invention.

A light emitting source 11 may be housed within the internal shield 23. A light emitting source holder 24 may further be coupled to the external shield 20 and extends downwardly therefrom. In this way, the external shield 20 and directional reflector 22 may contemporaneously rotate along a curvilinear path 90 spaced about the circumference of the internal shield 23. Such an arrangement provides the unexpected and unpredictable advantage of rotatably adjusting the external shield 20 of the apparatus 10 so that light may be efficiently reflected from the directional reflector 22 on a work area and at the same time allowing the directional reflector 22 to block the light from shining on and thus disturbing another person in close proximity to the user.

Figure 3:
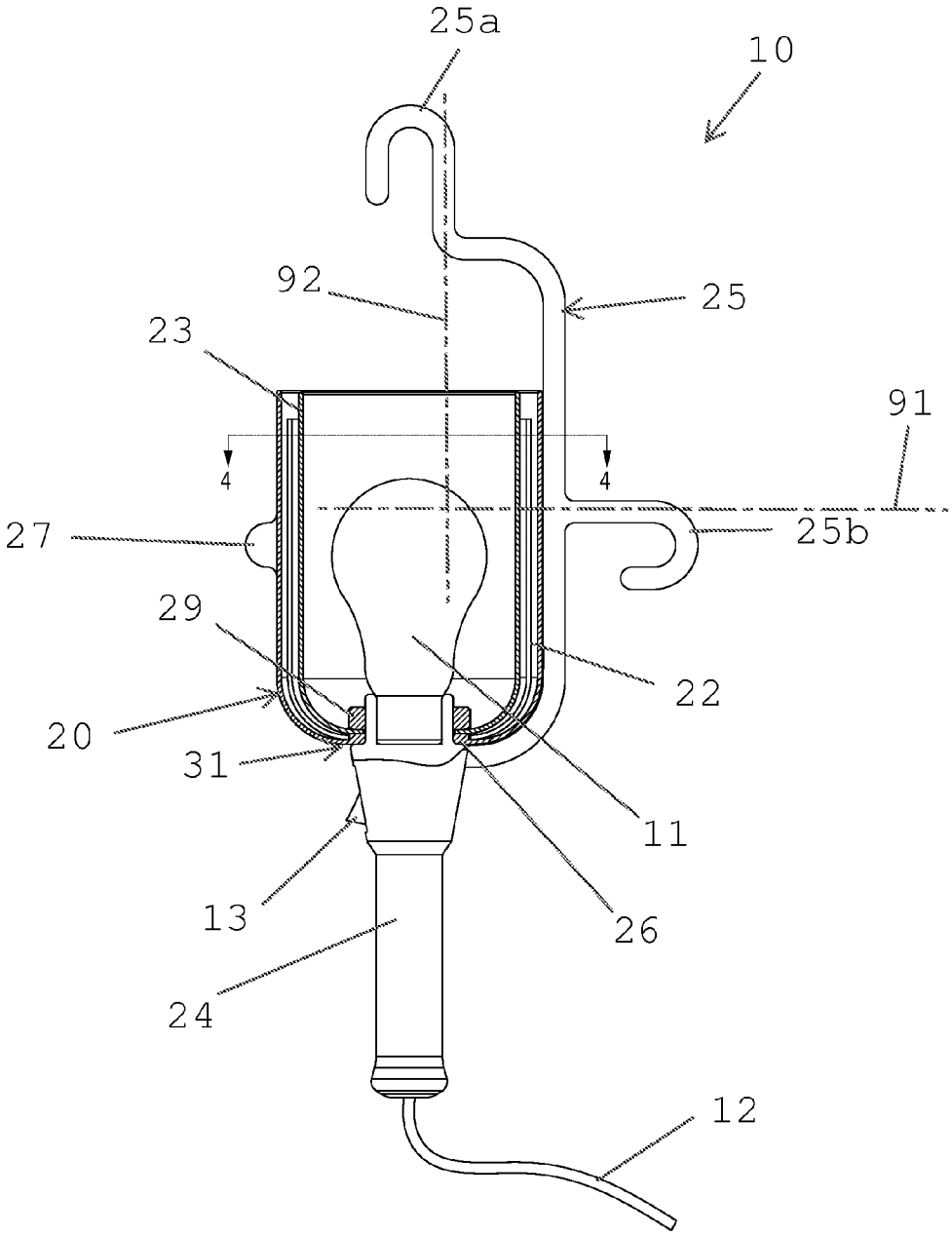
FIG. 3 is a cross-sectional view showing the structural interrelationship between the base, inner and outer shields and directional reflector.
Figure 4:
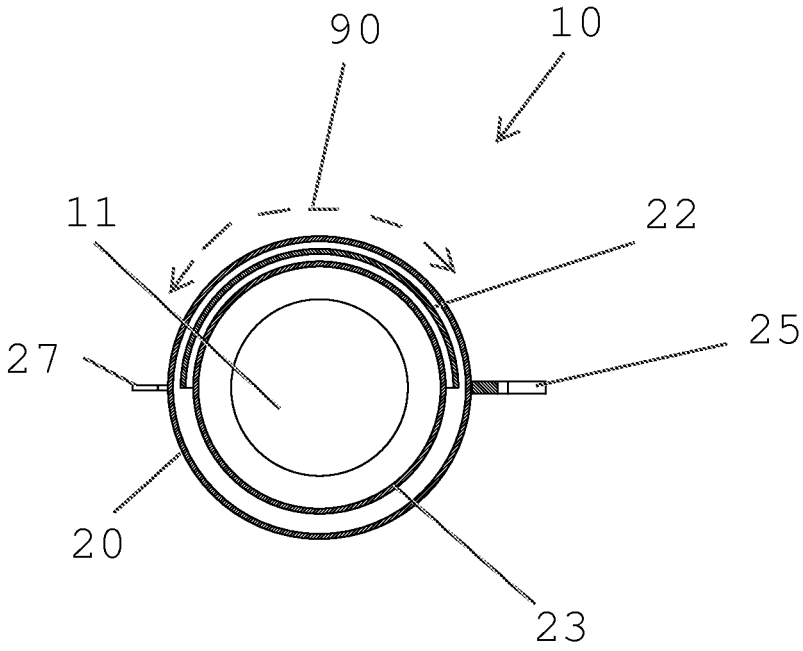
FIG. 4 is a cross-sectional view of the apparatus along line 4-4, shown in FIG. 3.

Referring to FIGS. 1, 3 and 4, the external shield 20 may include a tab 27 affixed to the external shield 20 and protruding outwardly from the circumference of the external shield 20. The tab 27 may remain spaced from the internal shield 23 and the directional reflector 22. Such a tab 27 may advantageously be used to rotate the external shield 20 and prevent the user's finger from touching and possibly being burned by the internal shield 23 as well as the direction reflector 22.

Figure 2:
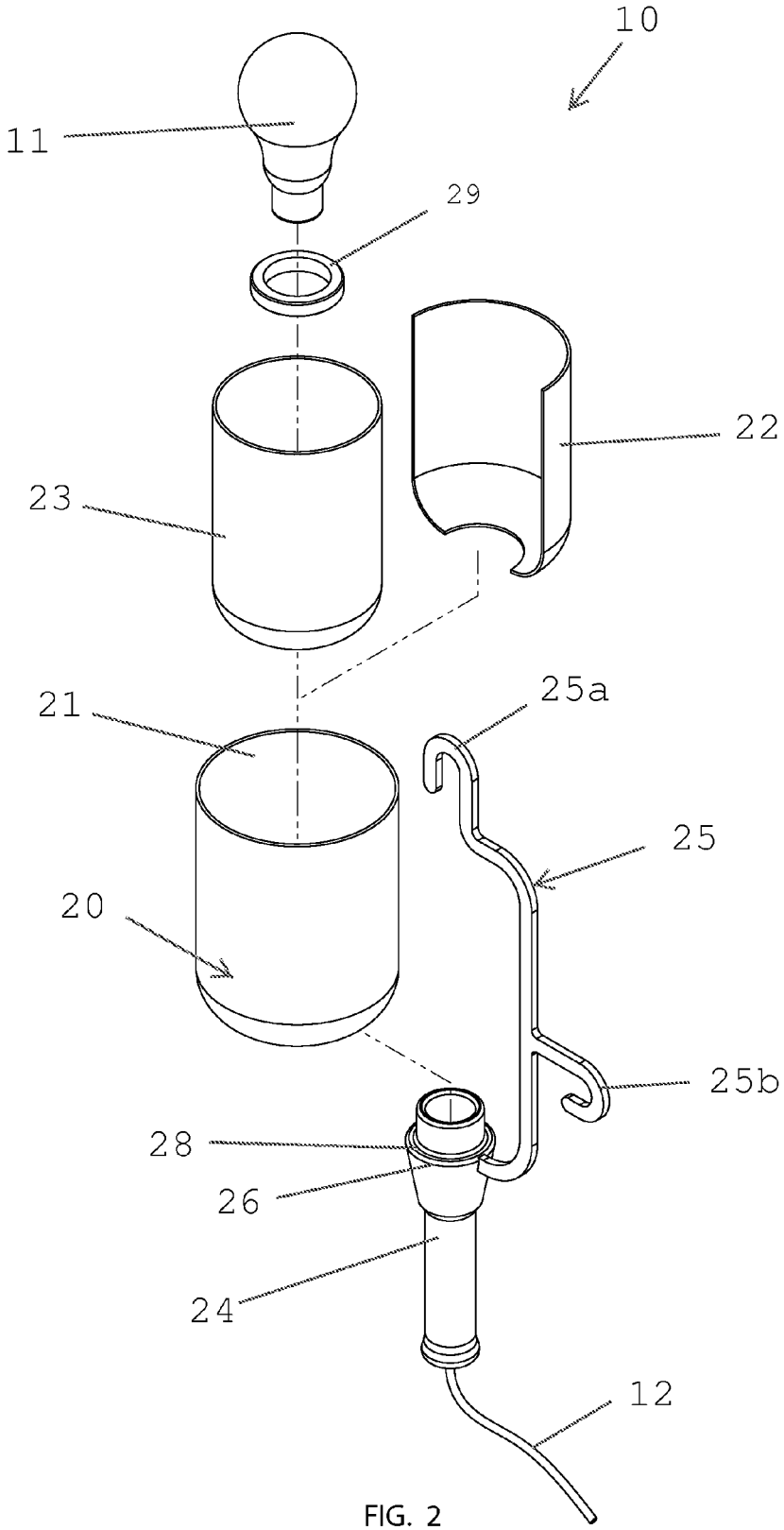
FIG. 2 is an exploded view of the apparatus shown in FIG. 1.

Referring now to FIGS. 2-3, the external shield 20 may include a base 31. Such a base 31 may include a lower hemisphere 26 rotatably and directly coupled to a top end of the light emitting source holder 24 and preferably having a circular track 28 formed along a top surface thereof. The base 31 may further include an upper hemisphere 29 dynamically and directly coupled to the top end of the light emitting source holder 24. The upper hemisphere 29 may further remain juxtaposed to the lower hemisphere 26. In this way, a bottom end of the internal shield 23 may be rotatably interfitted within the circular track 28 in such a manner that the internal shield 23 and the upper hemisphere 29 remain stationary as the lower hemisphere 26 rotates about the top end of the light emitting source holder 24. The external shield 20 and the directional reflector 22 concentrically rotate, with the lower hemisphere 26, about the internal shield 23 in such a manner that light is reflected away from the directional reflector 22 and outwardly through a portion of the internal and external shields 23, 20, respectively. Such an arrangement provides the unexpected and unpredictable advantage of rotating the external shield 20 and directional reflector 22 in sync with the lower hemisphere 26 while internal shield 23 and upper hemisphere 29 remain stationary. Such a configuration further alleviates the need to form a slot along the outer surface of the external shield 20 for guiding tab 27 therealong.

Referring to FIGS. 2 and 3, the apparatus 10 may further include a hanging arm 25 statically mated directly to the light emitting source holder 24 and extending upwardly therefrom. The hanging arm 25 may be abutted directly against an outer surface of the external shield 20 and travel along an entire longitudinal length thereof such that the hanging arm 25 terminates above the external shield 20. The hanging arm 25 may include a first hook 25*a* formed at a top end of the hanging arm 25 and a second hook 25*b* formed substantially medially between the top end of the hanging arm 25 and a bottom end of the hanging arm 25. In this way, the first hook 25*a* may be oriented perpendicular to the second hook 25*b* such that the directional reflector 22 is oriented along either a corresponding x or y axes 91, 92, respectively. As can be appreciated by one skilled in the art, the apparatus 10 will become aligned with the x or y axes upon hanging the apparatus 10 via first hook 25*a* or second hook 25*b*, respectively. Such an arrangement provides the unexpected and unpredictable advantage of allowing the apparatus 10 to be hung adjacent to or above a user thus providing a versatile light focusing source that is useful in a number of space-limited environments.

Referring to FIGS. 1 and 3, the light emitting source holder 24 may include a power cord 12 capable of being electrically coupled to an external power source (not shown) and a switch 13 located subjacent to the external shield 20. The switch 13 may be capable of toggling the light emitting source 11 between on and off modes while the internal shield 23 remains stationary.

In a non-limiting exemplary embodiment, the internal shield 23 may be removed wherein only the external shield 20 and directional reflector 22 rotate in sync. Such an embodiment may be used when a fluorescent light emitting source is employed rather than an incandescent light emitting source, so that heat from the light emitting source does not burn a user's hands, for example.

In yet another non-limiting exemplary embodiment, base 31 may be pivotally coupled to the top end of holder 24, rather than snap-fitted or threadably engaged thereto. Thus, as base 31 is pivoted to an open position that is offset from a center of holder 24, the external and internal shields 20, 23 as well as directional reflector 23 pivot in sync and away from the top end of holder 24. Such a configuration permits the user to install light emitting source 11 onto the holder 24 without having to completely detach base 31 from holder 24.

The invention may further include a method of utilizing a shielded droplight 10 for aiming light towards a work area. Such a method may include the chronological steps of: providing a rotatable external shield 20 preferably having a cylindrical shape with an open top end 21; providing and statically mating a semi-circular shaped directional reflector 22 to the external shield 20; spacing the directional reflector 22 inwardly from a circumference of the external shield 20; providing a stationary internal shield 23 preferably having a cylindrical shape; dynamically mating the internal shield 23 to the external shield 20 by spacing the internal shield 23 inwardly from a circumference of the directional reflector 22; providing and housing a light emitting source 11 within the internal shield 23; providing and coupling a light emitting source holder 24 to the external shield 20 such that the light emitting source holder 24 extends downwardly therefrom; and contemporaneously rotating the external shield 20 and directional reflector 22 along a curvilinear path 90 spaced about the circumference of the internal shield 23.

In one embodiment, a fastener 26 may be connected to a rear side of the external shield 20 for securely affixing the apparatus 10 to a support surface. Power may be distributed to the light emitting source 11 via a conventional power cable 12. The external and internal shields 20, 23 may be manufactured from durable clear plastic or other material well known in the art.

The apparatus 10 advantageously allows a user to focus desired light towards a specific work area thus reducing glare and preventing light from blinding his/her eyes. The apparatus 10 may further be used in applications such as automotive repairs, heating/cooling, construction, maintenance works, household projects and the like.

In use, the shielded droplight 10 would be simple and straightforward to use. First, the user may determine where his work area will be located such as a table or a work bench. He may install a hook at a suitable location close to his work area. Next the user may hang the apparatus 10 by means of the hooks 25*a*, 25*b* depending on where he/she would like to focus the light on. The user may then switch on the light emitting source 11 by toggling switch 13. Next, he may adjust the light beam towards his work area by rotating tab 27. Lastly, the user may go about the normal course of his/her work in clear bright lighting without disturbing another person close by who may not need the light. After use, the user may switch off the light; unhook the apparatus 10 and store for further use.

In an alternative embodiment, the shielded droplight 10 may feature a rechargeable power source for use where an AC power source is not readily available such as in outdoor areas or in the event that there is a power failure.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A shielded droplight for aiming light towards a work area, said shielded droplight comprising:

a rotatable external shield;

a directional reflector statically mated to said external shield and spaced inwardly from a circumference of said external shield;

a stationary internal shield being dynamically mated to said external shield and spaced inwardly from a circumference of said directional reflector;

a light emitting source housed within said internal shield; and a light emitting source holder coupled to said external shield and extending downwardly therefrom;

wherein said external shield and directional reflector contemporaneously rotate along a curvilinear path spaced about the circumference of said internal shield;

wherein said external shield comprises: a base comprising a lower hemisphere rotatably and directly coupled to a top end of said light emitting source holder, said lower hemisphere having a circular track formed along a top surface thereof; and an upper hemisphere dynamically and directly coupled to said top end of said light emitting source holder, said upper hemisphere remaining juxtaposed to said lower hemisphere such that a bottom end of said internal shield is rotatably interfitted within said circular track in such a manner that said internal shield and said upper hemisphere remain stationary as said lower hemisphere rotates about said top end of said light emitting source holder.

2. The shielded droplight of claim 1, wherein said external shield comprises:

a tab affixed protruding outwardly from the circumference of said external shield, said tab remaining spaced from said internal shield and said directional reflector.

3. The shielded droplight of claim 1, wherein said external shield and said directional reflector concentrically rotate about said internal shield in such a manner that light is reflected away from said directional reflector and outwardly through a portion of said internal and external shields respectively.

4. The shielded droplight of claim 1, further comprising: a hanging arm statically mated directly to said light emitting source holder and extending upwardly therefrom, said hanging arm being abutted directly against an outer surface of said external shield and traveling along an entire longitudinal length thereof such that said hanging arm terminates above said external shield.

5. The shielded droplight of claim 4, wherein said hanging arm comprises:

a first hook formed at a top end of said hanging arm; and a second hook formed substantially medially between said top end of said hanging arm and a bottom end of said hanging arm;

wherein said first hook is oriented perpendicular to said second hook such that said directional reflector is oriented along one corresponding x and y axes respectively.

6. The shielded droplight of claim 1, wherein said light emitting source holder comprises:

a power cord capable of being electrically coupled to an external power source; and a switch located subjacent to said external shield, said switch being capable of toggling said light emitting source between on and off modes while said internal shield remains stationary.

7. A shielded droplight for aiming light towards a work area, said shielded droplight comprising:

a rotatable external shield having a cylindrical shape with an open top end;

a semi-circular shaped directional reflector statically mated to said external shield and spaced inwardly from a circumference of said external shield;

a stationary internal shield having a cylindrical shape, said internal shield being dynamically mated to said external shield and spaced inwardly from a circumference of said directional reflector;

a light emitting source housed within said internal shield; and a light emitting source holder coupled to said external shield and extending downwardly therefrom;

wherein said external shield and directional reflector contemporaneously rotate along a curvilinear path spaced about the circumference of said internal shield;

a hanging arm statically mated directly to said light emitting source holder and extending upwardly therefrom, said hanging arm being abutted directly against an outer surface of said external shield and traveling along an entire longitudinal length thereof such that said hanging arm terminates above said external shield.

8. The shielded droplight of claim 7, wherein said external shield comprises:

a tab affixed protruding outwardly from the circumference of said external shield, said tab remaining spaced from said internal shield and said directional reflector.

9. The shielded droplight of claim 7, wherein said external shield comprises: a base comprising a lower hemisphere rotatably and directly coupled to a top end of said light emitting source holder, said lower hemisphere having a circular track formed along a top surface thereof; and an upper hemisphere dynamically and directly coupled to said top end of said light emitting source holder, said upper hemisphere remaining juxtaposed to said lower hemisphere such that a bottom end of said internal shield is rotatably interfitted within said circular track in such a manner that said internal shield and said upper hemisphere remain stationary as said lower hemisphere rotates about said top end of said light emitting source holder.

10. The shielded droplight of claim 7, wherein said external shield and said directional reflector concentrically rotate about said internal shield in such a manner that light is reflected away from said directional reflector and outwardly through a portion of said internal and external shields respectively.

11. The shielded droplight of claim 7, wherein said hanging arm comprises:

a first hook formed at a top end of said hanging arm; and a second hook formed substantially medially between said top end of said hanging arm and a bottom end of said hanging arm;

wherein said first hook is oriented perpendicular to said second hook such that said directional reflector is oriented along one corresponding x and y axes respectively.

12. The shielded droplight of claim 7, wherein said light emitting source holder comprises:

a power cord capable of being electrically coupled to an external power source; and a switch located subjacent to said external shield, said switch being capable of toggling said light emitting source between on and off modes while said internal shield remains stationary.

* * * * *